United States Patent [19]

Steidinger

[11] 4,179,140

[45] Dec. 18, 1979

[54] FORM SUITABLE FOR AIRLINE TICKETING

[75] Inventor: Donald J. Steidinger, Barrington, Ill.

[73] Assignee: Wallace Business Forms, Inc., Hillside, Ill.

[21] Appl. No.: 914,437

[22] Filed: Jun. 12, 1978

Related U.S. Application Data

[63] Continuation of Ser. No. 483,952, Jun. 28, 1974, Pat. No. 4,109,936, which is a continuation-in-part of Ser. No. 453,556, Mar. 21, 1974, which is a continuation-in-part of Ser. No. 374,274, Jun. 27, 1973.

[51] Int. Cl.[2] ..... B41L 1/20

[52] U.S. Cl. ..... 282/11.5 R; 282/24 R

[58] Field of Search ..... 282/11.5, 12, 20 R, 282/21 R, 22, 24 R; 270/52, 53

[56] References Cited

U.S. PATENT DOCUMENTS 3,877,728 4/1975 Herz ..... 282/11.5 A

*Primary Examiner*—Gerald A. Dost

*Attorney, Agent, or Firm*—Tilton, Fallon, Lungmus & Chestnut

[57] ABSTRACT

A form suitable for airline ticketing which includes as one exterior ply a web wider than intermediate plies and wherein the overlapping portion is equipped with control openings.

3 Claims, 6 Drawing Figures

FORM SUITABLE FOR AIRLINE TICKETING

This application is a continuation of my co-pending application Ser. No. 483,952 filed June 28, 1974 now U.S. Pat. No. 4,109,936 which was a continuation-in-part of my co-pending application Ser. No. 453,556 filed Mar. 21, 1974 which in turn was a continuation-in-part of my co-pending application Ser. No. 374,274 filed June 27, 1973.

BACKGROUND AND SUMMARY OF INVENTION

The present construction of an airline ticket includes up to 9 plies of paper. All the plies are equal in width and have control punch margins on both sides. The plies are glued together across the width of the web every 8½". In order to reduce the number of across-the-web glue pots required, approximately every other ply down through the set has a series of holes punches in a line across the web so that the glue lines printed on the back of the first ply can adhere to the second ply between the holes, and to the third ply through the holes.

The top ply of the set is carbon coated on the back. This ply is provided to avoid the need for an ink ribbon on the computer.

Cross perforations provide a stub so that the individual plies can be removed from the set one at a time as the ticket is used and also reduce the actual ticket to 7⅜" in length. This is the requirement of the optical scanner.

A cut is made through all plies across the width of the set not extending across the control punch margins. In use, the computer trims off the control punch margin from all plies. These longitudinal cuts intersect the cross cut as the ticket issues through the computer with the result that the issued ticket falls completely free from the supply pack of forms.

A first problem with the present construction is the difficulty to trim 9 plies reliably in an office type machine. Blades must be sharp and the form must not have bubbles due to slightly unequal lengths of the various plies. In short, everything must be just right or the trimming becomes poor in quality and troublesome in operation.

The second problem is the stop and go action of the ticket in the computer further aggravates the difficult slitting operation.

A third problem is that the tickets must be trimmed accurately in order to meet the optical scanner requirements on the used tickets. This is difficult when trimming 9 plies.

A fourth problem is the volume of trim which results when trimming both margins of a nine-part form—this causes real problems in where to store the trim as it comes from the computer, to remove it from the immediate area and how to finally dispose of it.

One ticket issuing computer plans to refold the trim in order to store it in a small space. In order to gain reliability in refolding 9 plies of trim, the plies are glued together with a longitudinal glue line between each ply. These glue lines add stiffness and "testing" to the forms. In any event, refolding of trim is unreliable.

The life of trimmer blades is short because their condition must be very good to trim 9 plies at all. The most advantageous arrangement is to run the slitter blades so their circumferential speed is at or very slightly above the paper speed. This gives the least pulling effect on the paper and the least rubbing effect on the blades. This arrangement is not possible when the form is indexed through the slitters in a stop and go manner. Here the circumferential speed of the blades must be at least as fast as the paper when it travels at its highest speed. This results in shortened blade life; the more plies that trimmed, the shorter the time the blades remain in good enough condition to cut properly.

According to the invention, the above-mentioned problems are avoided or substantially reduced by minimizing or even eliminating the trimming operation and by eliminating the tenting problem.

In the inventive construction, the bottom ply is full width with the margins or trim portions equipped with the control punch openings and the intermediate plies are narrow in width so that they do not require trimming. In the practice of the invention, the bottom ply acts as a carrier strip for the various other plies and the plies are simultaneously equipped with a line of weakness and adhered together for subsequent processing while being maintained in register by pin belts operating through register openings in the areas adhered together.

DETAILED DESCRIPTION

The invention is described in conjunction with the accompanying drawing, in which FIG. 1 is a fragmentary top plan view of a ticket form incorporating teachings of this invention;

Figure 1:
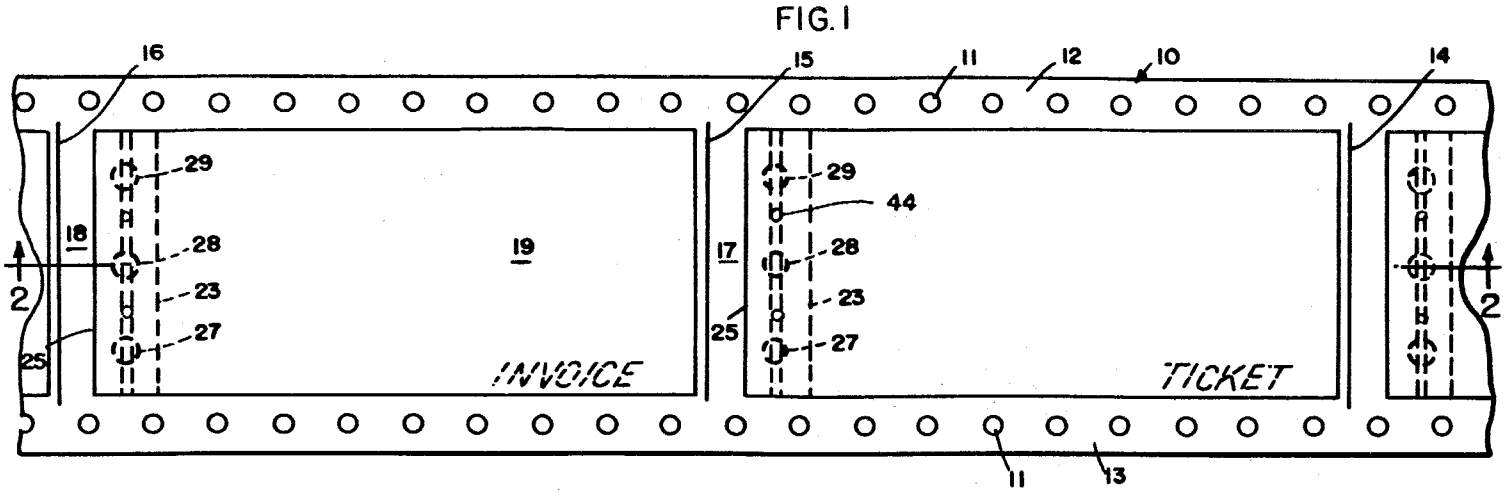
Figure 2:
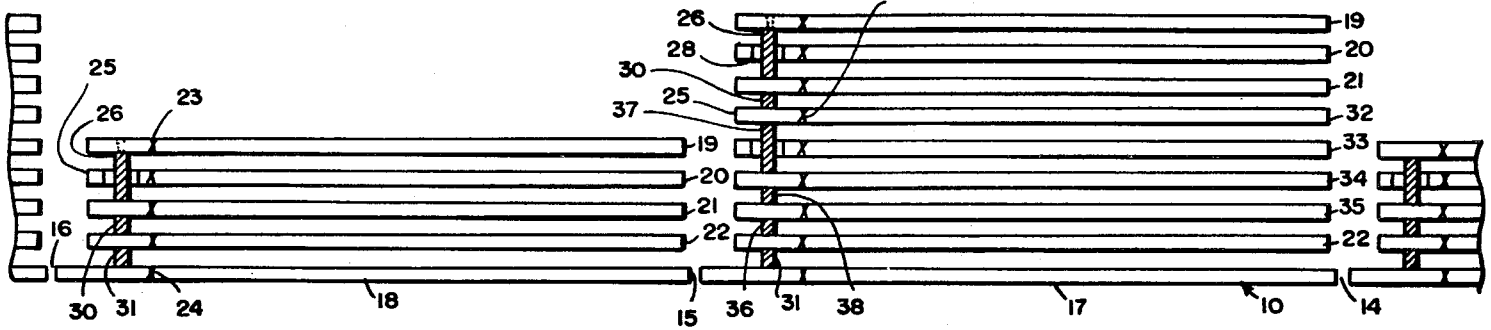
FIG. 2 is a longitudinal sectional view taken along the line 2—2 of FIG. 1 and with the various plies separated is exaggerated fashion to reveal details of construction.

In the illustration given and with reference to FIGS. 1 and 2, the numeral 10 designates generally an elongated web which is equipped with control punch openings as at 11 in the longitudinal margins or trim portions 12 and 13.

The web 10 is equipped with equally, longitudinally spaced apart slits as at 14, 15 and 16 which define discrete panels as at 17 and 18. As can be seen from FIG. 2, the panel 17 extends between the slits 14 and 15 while the panel 18 extends between the slits 15 and 16. It will also be appreciated that the width of the slits 14–16 is less than the width of the web 10, the slits 14–16 extending between the trim portions 12 and 13. In some instances—as where the computer printer is adapted to transversely sever as well as longitudinally slit the web 10, it is possible to utilize a different form of line of weakness at 14, 15 and 16 such as a line of perforation. Thus, a line of weakness includes both a slit and a perforation, or in some cases, a score.

For each panel I provide a plurality of layers or plies of paper or like web material which layers are generally rectangular and arranged in superposed, aligned relation.

For example, in the illustration given in FIGS. 1 and 2, the units including the panel 17 and 18 should be processed as a single element—the panel 18 supporting four plies used for invoicing while the panel 17 supporting eight plies for ticketing.

Referring first in FIG. 2 to the plurality of plies of web material supported on the panel 18, viz., (the left hand portion) it is seen that the plurality of plies includes those designated 19, 20, 21 and 22. Each of the plies 19–22 has a width equal to the space between the trim portions 12 and 13 and a length less than the distance between the adjacent slits, i.e., the distance between slits 15 and 16. Each of the plies 19–22 is equipped with a line of perforation as at 23 and the various lines of perforation are again superposed or vertically aligned with each other and with a similar line of perforation 24 provided in the panel 18.

The perforation lines 23 are adjacent to but spaced from the adjacent end 25 of the plurality of lines 19–22 to provide a stub. The spacing between the line 23 and the end 25 (see the left hand end of FIG. 1) provides a space for adhesively securing or otherwise uniting the various plies 19–22 and the panel 18. As can be appreciated from a comparison of FIGS. 1 and 2, the underside of the ply 19 is coated with a line of adhesive 26. The ply 20 is equipped with a plurality of openings as at 27, 28, and 29 in this same space, viz., between the line 23 and the end 25. Thus, the line of openings 26 connects the ply 19 to the ply 20 through the openings and connects the ply 19 to the ply 21 through the openings. Further lines of adhesive are provided as at 30 and 31 (see FIG. 2) which connect the plies 21 and 22 and the ply 22 to the panel 18, respectively. These lines of adhesive 30 and 31 are highly exaggerated for the purpose of ease of understanding the structure involved.

Above the panel 17 (again referring to FIG. 2), a larger stack or plurality of plies is seen—as contrasted to those of the panel 18. The plies above the panel 17 include the following: 19–21, 32–35 and 22. Each of the plies is equipped with a line of perforation 23 and an adjacent end 25 and in the space between these two lines, the plies are united.

Figure 3:
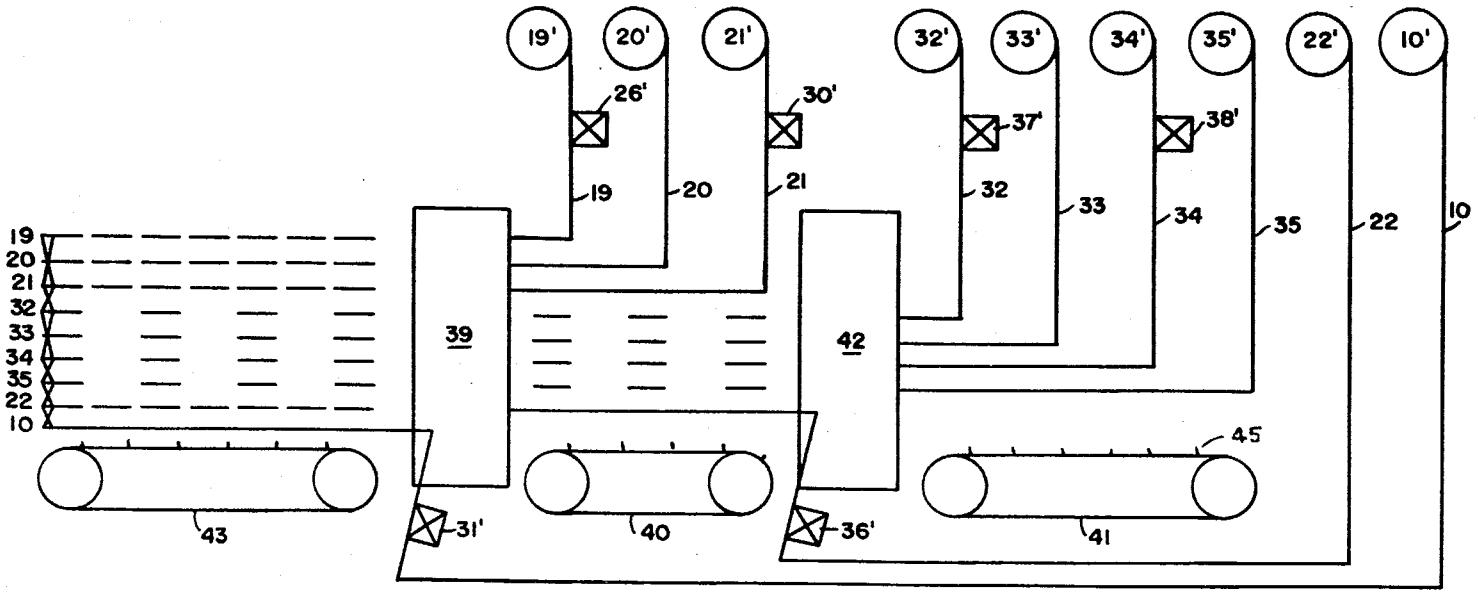
FIG. 3 is a schematic side elevational form of apparatus employed in the production of the ticket form of FIGS. 1 and 2.

To better understand the relationship of the plies above the panel 17 to those above the panel 18, reference is made to FIG. 3. At the upper portion of FIG. 3 it will be noted that there are nine parent rolls 19′–21′, 32′–35′, 22′ and 10′ which provide the web material for the various plies—the parent rolls having the same designation as the plies except for the addition of a prime (′).

For example, a web 19 (see FIG. 3) is unwound from the parent roll 19′ and passes through a gluing station 26′. The gluing station lays down the line of adhesive 26 on the underside of the web 19 at longitudinally spaced areas. Thus, the gluing station has the same designation as the line of adhesive it applies, except for the addition of a prime (′).

Proceeding to the right in FIG. 3, a parent roll 20′ is unwound to provide the web 20. The web 20 is equipped with the adhesive openings 27–29 and is ultimately brought into engagement with web 19.

Proceeding still further to the right, the parent roll 21′ is unwound to provide the web 21 and the underside of this web passes through a gluing station 30′ which applies the line of adhesive 30.

Now referring to the second to the last parent roll 22′, it will be seen that this provides the web 22 which passes through a gluing station 36′ and which applies to the web 22 longitudinally spaced, transversely extending lines of adhesive 36 which mate with the adhesive line 30 provided by the glue-providing element 30′. In other words, the glue lines 36 are not needed to connect plies 21 and 22 above the panel 18 but are required to connect the plies 22 and 35 above the panel 17—the glue line 30 having been used in the arrangement above panel 17 to connect the plies 21 and 32. Thus, the gluing station 36′ is not required to provide the ply arrangement supported on the panel 18 but it required for the ply arrangement supported above the panel 17.

The panel 17 is seen to include four additional plies 32–35 which are introduced between the plies 21 and 22 of the arrangement supported above the panel 18. By this arrangement an inefficiency of the prior art ticket-invoice form is avoided—it no longer being necessary to throw away the unused plies of the invoice portion.

Referring again to FIG. 3, the web 32 is provided by unwinding the parent roll 32′ while the web 33 is unwound from the parent roll 33′. The web 33 also is equipped with the adhesive openings 27–29. The ply 32 is unwound from the parent roll 32′ and, as can be seen from FIG. 2, is also adhered to the web 21 by the line of adhesive 30. Applied to the underside of the web 32 is a line of adhesive 37 provided by the glue unit 37′. The line of adhesive 37 unites the webs 32–34 in the fashion indicated previously, i.e., the web 33 which is provided by the parent roll 33′ has the adhesive openings 27–29. Webs 34 and 35 are unwound from parent rolls 34′ and 35′ respectively with a line of adhesive 38 being applied by the glue unit 38′ to the underside of web 34 for uniting webs 34 and 35. It will be seen that the web 22 is adhesively secured to the underside of the web 35 (see FIG. 2) by means of a line of adhesive 36. Lastly, the web 10 is unwound from the parent roll 10′ and is equipped with lines of adhesive 31 from the adhesive unit 31′.

Still referring to FIG. 3, it will be seen that the web 10 constitutes a carrier strip which alternately supports eight or four plies thereabove, as the case may be. Depending upon the printing arrangement, the web 10 may either be the bottom ply (as seen in FIGS. 1 and 2) or the top ply of a ticket form where the printing is reversed, i.e., on the opposite side from that shown. Here it will be appreciated that the operations and features which are common to the presently used airplane ticketing forms have been omitted for clarity of presentation, these including the means for printing, providing the adhesive openings 27–29, the line hole punching for the openings 11, the means for creating the transverse perforations 23, etc.

For the invoicing form which includes the plies 19–22 and the panel 18, it will be seen from FIG. 3 that the webs 19–21 and the web 22 are provided by the use of a cutoff device 39 which removes discrete portions, i.e., chips, from the respective webs so as to develop narrower, shorter plies than that developed from the bottom ply carrier strip 10. In this connection, the web 22 is used also as a carrier strip and is advanced under the control of a pin belt as the pin belt mechanism 43 for the bottom ply carrier strip 10.

The webs 32–35 are advanced by another pin belt mechanism 41 which operates at one-half the speed of the mechanisms 40 and 43. The superposed webs 32–35 are subjected to a cutoff mechanism 42 which develops the plies 32–35 for alternative panels, with the total assembly being ultimately advanced by the pin belt mechanism 43, all of the pin belt mechanisms being equipped with upstanding pins 45 which operate in conjunction with register openings 44 (see FIGS. 1 and 2). The openings 44 extend through all plies and are vertically aligned to give positive control and registration to the superposed webs. The openings 44 are advantageously placed between the glue openings 27–29, and thus are in an unused portion of the form, i.e., the stub.

It will be appreciated that in certain instances it may be desirable to confine all of the plies 19–22 and 32–35 within two wider strips, i.e., providing a top ply as a counterpart to the bottom ply 10. This ply can be conveniently introduced following the cutoff mechanism 39.

The ticket just described overcomes the problem of "tenting". A difference in length among the various plies in the prior form due to the difference in their path at the fold perforation results in either (a) forms that lay flat in the folded pack but have bubbles when unfolded; or (b) they lay flat when unfolded but cause wrinkles when the forms are in the pack. This causes wrinkles to be ironed in when the forms are in the pack. This happens particularly when the glue dried before folding. This is avoided by the construction just described.

Figure 4:
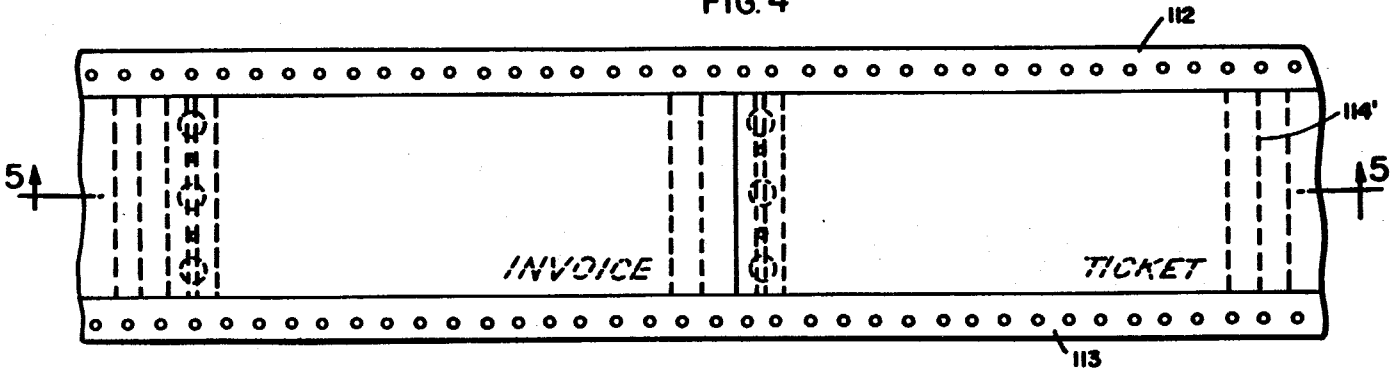
FIG. 4 is a view similar to FIG. 1 but of a modified form of the invention.
Figure 5:
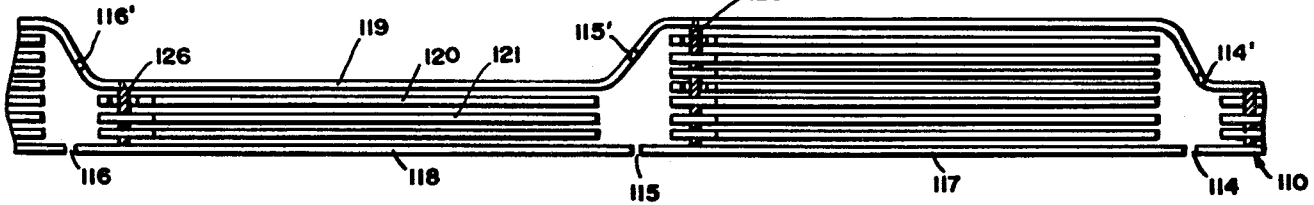
FIG. 5 is a fragmentary longitudinal sectional view taken along the line 5—5 of FIG. 4 and exaggerated or expanded between the plies to again reveal details of construction.

A still further modification of the invention can be appreciated from a consideration of FIGS. 4 and 5. The arrangement in FIGS. 4 and 5 is essentially similar to that seen in FIGS. 1 and 2 but with the exception that the top ply is continuous rather than provided in discrete segments.

For example, it can be seen in FIGS. 4 and 5 that the uppermost ply 119 is continuous between adjacent pluralities of plies, i.e., those supported on the panels 117 and 118 but separable along perforation lines 114'–116'. In connection with the embodiment of the invention depicted in FIGS. 4 and 5, like numerals are used to those employed in connection with embodiments of FIGS. 1–3 but increased by 100. Thus, the panel 117 is associated with a higher plurality of plies than is the panel 118. Like gluing operations are performed to form, as for example, the glue lines 126 which interconnect the plies 119, 120 and 121. After the ply 119 has been applied, it can be transversely slit as at 115' in line with the slit 115 applied to the continuous web 110.

It will be appreciated that again, depending upon the side receiving the printing, either the web 110 or the ply 119 may be the top ply or layer. Normally, the top ply is employed only during the printing operation and is removed thereafter—being removed before presentation to the customer in any event. Suitable additional transverse perforations can be provided in the exterior plies to remove any unwanted extra or overlapping length portions.

Figure 6:
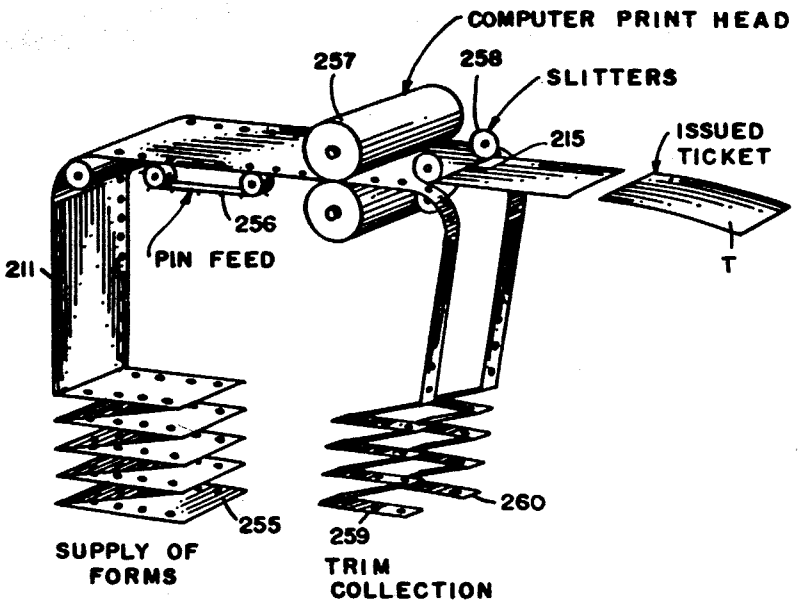
FIG. 6 is a fragmentary perspective view, partially schematic, of apparatus for processing the inventive ticket forms.

The procedure of computer printing is depicted in FIG. 6 and in connection with a form of ticket wherein both top and bottom plies, i.e., the exterior plies, are wider and longer than the exterior plies. In essence, this is similar to the embodiment of FIGS. 1–3 except that both top and bottom plies are full width and control punched. The control punch margins may be glued or not glued to meet the preference of the airline and it is apparent that this form requires two-ply trimming.

In FIG. 6, the numeral 255 denotes a supply of forms which are arranged in zigzag folded condition. The forms are advanced by virtue of a pin feed mechanism generally designated 256 which engages the line holes 211 along the longitudinal edges of the multi-ply web. The web in its unfolded condition passes through a computer print head 257 and thereafter is engaged by slitters 258. It will be seen that the trim naturally falls into a zigzag configuration and establishes two stacks 259 and 260. At the slitters pass by the transverse slits as at 215 in FIG. 6, a ticket T is separated from the continuous web.

With the construction of FIGS. 1, 2, 4 and 5, the problem of tenting or bubbling is eliminated because at the most, only the exterior plies and preferably only one exterior ply acts as a carrier strip. Therefore, the various other plies lie flat both in the pack (zigzag folded) and when in unfolded condition—because the various plies do not have different path lengths around the folds. Further, the quantity of trim or waste material is reduced substantially as well as presenting much lower volumes of paper to the slitters so that the problem of maintaining the slitters sharp is much less critical than with the present type of forms. Also, the instant invention makes possible an advantageous ticket-invoice structure where different numbers of plies can be introduced into the ticket and invoice portion, and without difficulty in production.

Also within the purview of the invention is the assembly where trimming is completely avoided. Such an assembly is advantageously achieved by having only the top ply of wider character. This top ply is removed and discarded before presentation of the ticket to the customer.

I claim:

1. A form suitable for processing to provide airline ticketing, comprising:

an elongated web having a plurality of equally longitudinally spaced lines of weakness extending transversely to provide discrete ticketing panels, a plurality of generally rectangular, superposed plies of web material for each panel, said plurality of plies and the associated panel being secured together with said panel providing one exterior of said form, alternate of said pluralities of plies having more plies than the intervening pluralities.

2. The form of claim 1 wherein the panel equipped with the lesser number of plies constituting invoicing means while other panels provide tickets.

3. A form suitable for processing to provide airline ticketing, comprising:

an elongated web equipped with trim portions along the longitudinal edges thereof, a plurality of longitudinally aligned control openings in each trim portion, a plurality of equally longitudinally spaced lines of weakness in said web extending transversely between said trim portions to provide discrete ticketing panels, a plurality of generally rectangular, superposed plies of web material for each panel, the plies in each plurality having a width so as to fit between said trim portions, said plurality of plies and the associated panel being secured together in said space with said panel providing one exterior of said form, alternate of said pluralities of plies having more plies than the intervening pluralities.

* * * * *